US011015907B2

(12) United States Patent
Heiche

(10) Patent No.: US 11,015,907 B2
(45) Date of Patent: May 25, 2021

(54) METHOD AND ARRANGEMENT FOR MODIFYING A SEPARABLE PROJECTILE

(71) Applicant: BAE SYSTEMS BOFORS AB, Karlskoga (SE)

(72) Inventor: Ulf Heiche, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 94 days.

(21) Appl. No.: 16/332,809

(22) PCT Filed: Sep. 14, 2017

(86) PCT No.: PCT/SE2017/050901
§ 371 (c)(1),
(2) Date: Mar. 13, 2019

(87) PCT Pub. No.: WO2018/052365
PCT Pub. Date: Mar. 22, 2018

(65) Prior Publication Data

US 2019/0204054 A1 Jul. 4, 2019

(30) Foreign Application Priority Data

Sep. 15, 2016 (SE) ..... 1630224-2

(51) Int. Cl.
*F42B 12/62* (2006.01)
*F42B 30/00* (2006.01)
(Continued)

(52) U.S. Cl.
CPC ..... *F42B 12/625* (2013.01); *F42B 12/365* (2013.01); *F42B 30/006* (2013.01); *F42B 35/00* (2013.01)

(58) Field of Classification Search
CPC ..... F42B 12/625; F42B 12/365; F42B 35/00; F42B 30/006
(Continued)

(56) References Cited

U.S. PATENT DOCUMENTS 2,246,429 A * 6/1941 Brandt ..... F42B 12/625 102/519
2,945,442 A * 7/1960 Adelman ..... F42B 15/36 102/378
(Continued)

FOREIGN PATENT DOCUMENTS

DE 202004010194 U1 * 11/2005 ..... F42B 12/365
DE 202004010194 U1 11/2005
(Continued)

OTHER PUBLICATIONS

International Search Report (dated Oct. 25, 2017) for corresponding International App. PCT/SE2017/050901.

*Primary Examiner* — Joshua E Freeman
(74) *Attorney, Agent, or Firm* — WRB-IP LLP

(57) ABSTRACT

A method for modifying a separable projectile between a test embodiment or an effect embodiment includes detaching the front projectile body from the rear projectile body, arranging a payload container in the front projectile body where the payload container comprises measuring equipment or an effect part, and fitting the front projectile body to the rear projectile body by way of a belt. A separable projectile which can be modified between a test embodiment and an effect embodiment is also provided.

11 Claims, 1 Drawing Sheet

(51) Int. Cl.
*F42B 12/36* (2006.01)
*F42B 35/00* (2006.01)

(58) Field of Classification Search
USPC ..... 102/489
See application file for complete search history.

(56) References Cited

U.S. PATENT DOCUMENTS 3,038,407 A * 6/1962 Robertson ..... F42B 10/56 102/340
3,055,300 A * 9/1962 Stoehr ..... F42B 4/12 102/339
3,139,795 A * 7/1964 Altschuler ..... F41A 9/72 89/1.818
3,185,090 A * 5/1965 Weber ..... F42B 15/38 89/1.14
3,397,638 A * 8/1968 Gould ..... F42B 15/36 102/377
3,431,852 A * 3/1969 Fowler ..... F42B 12/625 102/334
3,513,777 A * 5/1970 Hannold ..... F42B 12/56 102/501
3,837,278 A * 9/1974 Gustafsson ..... F42B 12/70 102/351
3,839,962 A * 10/1974 Popovitch ..... F42C 21/00 102/340
4,119,037 A * 10/1978 Romer ..... F42B 12/62 102/489
4,226,185 A * 10/1980 Tobler ..... F42B 10/56 102/340
4,294,172 A * 10/1981 Rauschert ..... F42B 12/62 102/473
4,333,400 A * 6/1982 McNelia ..... F42C 21/00 102/348
4,353,302 A * 10/1982 Strandli ..... F42B 12/44 102/364
4,457,207 A * 7/1984 Eriksson ..... F41A 21/12 89/14.05
4,498,393 A * 2/1985 Fischer ..... F42B 12/62 102/387
4,498,394 A * 2/1985 Regebro ..... F41G 7/222 102/378
4,505,202 A * 3/1985 Fidler ..... F42B 14/06 102/357
4,614,318 A * 9/1986 Gobel ..... F42B 12/62 102/489
4,953,813 A * 9/1990 Postler ..... F42B 10/56 244/147
5,111,748 A * 5/1992 Thurner ..... F42B 10/56 102/387
5,277,460 A * 1/1994 Grainge ..... F16B 7/0406 285/309
5,299,503 A * 4/1994 Frehaut ..... F42B 12/62 102/357
5,370,057 A * 12/1994 Badura ..... F42B 12/625 102/378
5,386,781 A * 2/1995 Day ..... F42B 4/28 102/337
5,394,803 A * 3/1995 Mort ..... F02K 9/38 102/377
5,760,330 A * 6/1998 Himmert ..... F42B 12/62 102/489
5,835,051 A * 11/1998 Bannasch ..... F41H 9/00 342/12
5,895,882 A * 4/1999 Woodall, Jr. ..... F42B 12/42 102/341
7,600,421 B1 * 10/2009 Hollis ..... F42B 12/365 102/510
8,757,671 B2 * 6/2014 Pallini, Jr. ..... E21B 17/085 285/322
9,528,802 B1 * 12/2016 Markowitch ..... F42B 10/56
10,030,953 B2 * 7/2018 Adams ..... F42B 4/28
2001/0009634 A1 * 7/2001 Giesenberg ..... F42B 15/36 403/338
2004/0139877 A1 * 7/2004 Ronn ..... F42B 12/58 102/489
2004/0196367 A1 * 10/2004 Raymond ..... H04N 7/183 348/144
2005/0066838 A1 * 3/2005 Doughty ..... F42B 12/62 102/357
2005/0193916 A1 * 9/2005 Cleveland ..... B64G 1/645 102/378
2008/0011180 A1 * 1/2008 Stimpson ..... F42B 33/001 102/377
2009/0145323 A1 * 6/2009 Gustavsson ..... F42B 14/02 102/524
2011/0036261 A1 * 2/2011 Krisher ..... F42B 10/46 102/378
2011/0041720 A1 * 2/2011 Brill ..... F42C 11/065 102/266
2011/0044751 A1 * 2/2011 Diehl ..... F16L 35/00 403/2
2012/0138319 A1 * 6/2012 Demmitt ..... A62C 8/005 169/28
2013/0011189 A1 * 1/2013 Kamiya ..... F16B 7/0426 403/338
2013/0199359 A1 * 8/2013 Kister ..... F42B 15/38 89/1.14
2015/0128823 A1 * 5/2015 Akcasu ..... F42B 12/365 102/517
2015/0211832 A1 * 7/2015 Travis ..... F42B 15/36 285/90
2016/0033069 A1 * 2/2016 Buttolph ..... F16L 37/101 403/320
2017/0007865 A1 * 1/2017 Dor-El ..... A62C 3/0271
2017/0074619 A1 * 3/2017 Dominguez ..... F42B 15/01
2017/0341782 A1 * 11/2017 Rivas Sánchez ..... B64G 1/641
2019/0086188 A1 * 3/2019 Jansson ..... F42B 10/56
2019/0204054 A1 * 7/2019 Heiche ..... F42B 30/006
2020/0393225 A1 * 12/2020 Christensen ..... F41G 3/02

FOREIGN PATENT DOCUMENTS

EP 2871438 A1 5/2015
FR 2336656 A1 7/1977
FR 2679644 A1 * 1/1993 ..... F42B 12/62
FR 2679644 A1 1/1993
GB 2022223 A 12/1979

* cited by examiner

METHOD AND ARRANGEMENT FOR MODIFYING A SEPARABLE PROJECTILE

BACKGROUND AND SUMMARY

The present invention relates to a method and an arrangement for modifying a separable projectile.

Separable projectile designs for the separation of one or more effect charges in the forward direction of the projectile are disclosed by the following patent documents: U.S. Pat. No. 4,333,400A US Navy 1980, U.S. Pat. No. 3,839,962 US Army 1973 and U.S. Pat. No. 3,513,777 US Army 1968, among others.

In the testing of a separable projectile as described above various types of measuring equipment are normally used in the projectile for registering parameters such as acceleration stresses, velocity, pressure etc., during the launch phase and trajectory phase of the projectile. Recovery of the measuring equipment after testing for evaluation of the measurement data is done, for example, by slowing a projectile in compacted bales backed by a sand trap. The method has proved less suitable, however, for certain types of sensitive measuring equipment.

A need therefore exists for a separable projectile arranged in a test embodiment, comprising a recoverable measuring equipment for measuring characteristics of the projectile during the acceleration and trajectory phase without damaging the measuring equipment after testing.

It is also desirable that said separable projectile should be easy to modify from a test embodiment for testing out the projectile to an effect embodiment for terminal effect.

It is desirable to provide a separable projectile arranged in a test embodiment for measuring characteristics of the projectile during the acceleration and trajectory phase of the projectile without ensuing damage to the measuring equipment.

It is also desirable to provide a method for modifying a separable projectile in that the projectile can easily be modified from a test embodiment to an effect embodiment; which means that the projectile is produced in an unmodified state. The payload container, adapted for holding the measuring equipment or the effect charge, is produced and supplied separately. This affords flexibility in modifying said projectile to the desired form, that is to say the test embodiment or the effect embodiment.

According to an aspect of the present invention, a method has been provided for modifying a separable projectile from a test embodiment to an effect embodiment and vice versa, the projectile comprising a payload container and a separation charge arranged behind the payload container for separating the payload container from the projectile in the forward direction of the projectile.

A characteristic feature of the method is that the projectile is modified from the test embodiment to the effect embodiment in that the payload container is changed from a payload container comprising measuring equipment to a payload container comprising an effect part by:

detaching the front projectile body from the rear projectile body, arranging a payload container in the front projectile body where the payload container comprises measuring equipment or at least one effect part, and fitting the front projectile body to the rear projectile body by way of a belt.

According to the present invention a separable projectile has also been provided, comprising a payload container and a separation charge arranged behind the payload container for separating the payload container from the projectile in the forward direction of the projectile, the projectile being modifiable from a test embodiment to an effect embodiment by changing the payload container.

According to a second embodiment of the separable projectile the separation charge consists of or comprises a propellant charge comprising a smokeless nitrocellulose propellant.

According to a third embodiment of the separable projectile the projectile comprises a pyrotechnic primer charge for initiating the propellant charge.

According to a fourth embodiment of the separable projectile the projectile comprises a fuse for initiating the pyrotechnic primer charge.

According to a fifth embodiment of the projectile in a test embodiment the payload container comprises a measuring equipment for measuring the acceleration stresses, velocity, altitude, temperature etc. of the projectile during the acceleration and trajectory phase of the projectile.

According to a sixth embodiment of the projectile in the test embodiment the payload container is connected to a parachute for recovery of the payload container after separation from the projectile.

According to a seventh embodiment of the projectile in the effect embodiment the payload container consists of or comprises an integral unit, entirely or partially closed.

According to an eighth embodiment of the projectile in the test embodiment the parachute is arranged and packed in a separable parachute container on or in the rear part of the payload container.

According to a ninth embodiment of the projectile in the effect embodiment the payload container comprises at least one effect part comprising at least one effect projectile and at least one explosive charge for aimed effect against a target.

According to a tenth embodiment of the projectile in an effect embodiment the payload container comprises a delay charge for delayed initiation of said effect part.

According to an eleventh embodiment of the projectile in an effect embodiment the payload container is capable of separating into two or more parts after separation for release of the effect part.

According to a twelfth embodiment of the projectile in an effect embodiment the projectile comprises a fuse for initiating the pyrotechnic primer charge and the pyrotechnic delay charge.

The invention, according to an aspect thereof, affords a series of advantages and effects, the most important of which are:

Modification of the separable projectile from a test embodiment to an effect embodiment by changing the payload container affords a simplified and cost-effective method in which the projectile can be drawn directly from one and the same production line irrespective of the form of embodiment.

The separation of a payload container, comprising one or more effect charges, in the forward direction of the projectile prevents potentially disruptive action from the projectile body on the effect charge during the effect phase of the projectile.

The separation of a payload container, comprising a measuring equipment and a parachute, in the forward direction of the projectile allows recovery of the measuring equipment without damage occurring to the measuring equipment.

BRIEF DESCRIPTION OF THE DRAWINGS

Further advantages and effects of the invention will emerge from a study and consideration of the following, detailed description of the invention, referring to the figures of the drawing 1, in which.

DETAILED DESCRIPTION

The invention, according to an aspect thereof, relates to a method for modifying a separable projectile from a test embodiment to an effect embodiment or vice versa.

The basic construction of the projectile is such that the projectile can easily be modified from the test embodiment to the effect embodiment by changing the payload container. In a test embodiment the payload container is characterized in that that it comprises sensitive measuring equipment for measuring characteristics of the projectile during the launch and trajectory phase of the projectile. The payload container is also connected to a parachute for recovery of the payload container after separation from the projectile. In the effect embodiment the payload container is characterized in that it comprises an effect part comprising one or more effect projectiles and effect charges for effect against a target after separation of the payload container.

The content of the payload container differs, therefore, depending on the embodiment of the projectile. In order to fit the payload space of the projectile regardless of the embodied form of the projectile, the payload containers are of similarly shaped design, preferably cylindrical, and of the same size.

The payload containers differ, however, with regard to their construction. In an effect embodiment the payload container preferably comprises a longitudinally dividable cylinder, comprising two cylinder halves fixed to one another so that the payload container, after separation from the projectile, divides into two halves for release of the effect part in the forward direction of the projectile. In a test embodiment the payload container consists of or comprises an integral unit which does not divide after separation, entirely or partially closed, for safe preservation of the measuring equipment during the course of testing. In a special embodiment, not shown, the cylindrical payload container comprises a rear cylindrical cavity for the connection of a parachute or a container holding a parachute.

In said test embodiment the payload container is connected to a parachute for recovery of the payload container after separation from the projectile.

The parachute, preferably packed in a separate, detachable parachute container, is arranged in or adjacent to the rear end of the payload container, preferably in the cylindrical cavity. The parachute container is preferably designed as a separable cylindrical module detachably fitted adjacent to or in the rear cylindrical part of the payload container, for example by snap fasteners.

Figure 1:
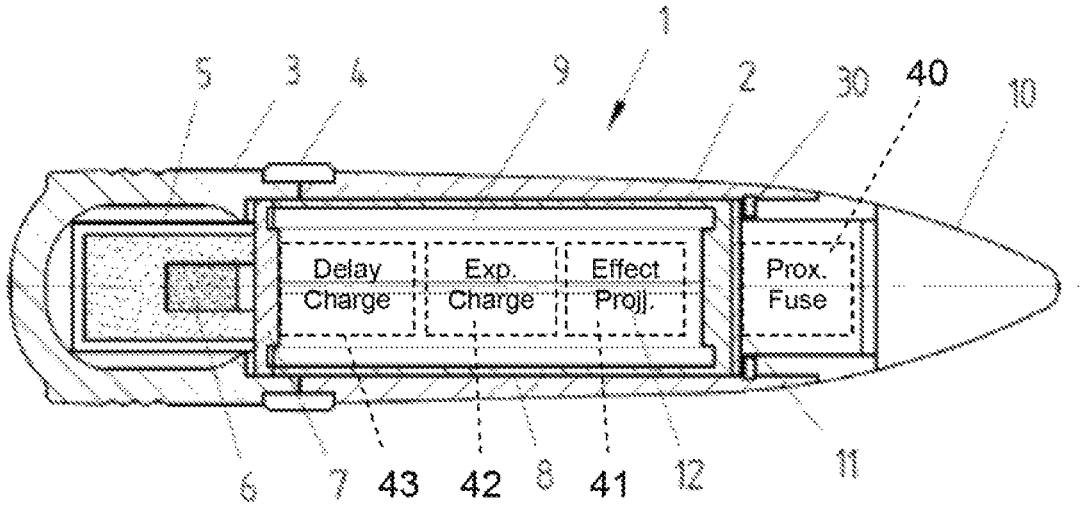
FIG. 1 schematically shows a longitudinal section of a separable projectile in an effect embodiment, comprising a payload container comprising an effect charge, and a separation charge for separating the container with a payload from the projectile.

FIG. 1 shows the separable projectile 1 in an effect embodiment for effect in the forward direction of the projectile 1. The projectile 1 comprises a front projectile body 2 and a rear projectile body 3 joined by a belt 4, the belt 4 joining the rear projectile body to the front projectile body by means of a threaded connection, shrink connection and/or press-fit connection, for example.

The rear projectile body 3 comprises a separation charge 5 and a pyrotechnic primer device 6 for initiating the separation charge 5. The primer device 6 is arranged in front of the separation charge 5 behind a drive plate 7 adjacent to the rear end of a payload container 8 and the front projectile body 2. The separation charge 5 preferably consists of or comprises a propellant charge of conventional type, for example a propellant charge comprising a smokeless nitrocellulose propellant, or in an alternative embodiment a composite propellant.

The payload container 8 which is arranged in the front projectile body 2 and comprises at least one effect part 9 comprising one or more effect projectiles 41 and effect (explosive) charges 42 together with one or more delay charges 43 for delayed initiation of said minimum of one effect part 9. A proximity fuse 40 comprising an activation unit for activating the primer device 6, is arranged in the nose part 10 of the front projectile body 2, in front of the payload container 8. The nose part 10 is fitted to the front projectile body 2 by a second drive plate 11 and by shear pins 30, which are designed to rupture under the effect of the pressure on the separation of the payload container 8 from the projectile 1. In an alternative embodiment a continuous detonator wire 12, preferably a nonel, is arranged between the pyrotechnic primer device 6 and the second drive plate 11 for separating the nose part 10 from the projectile 1.

Figure 2:
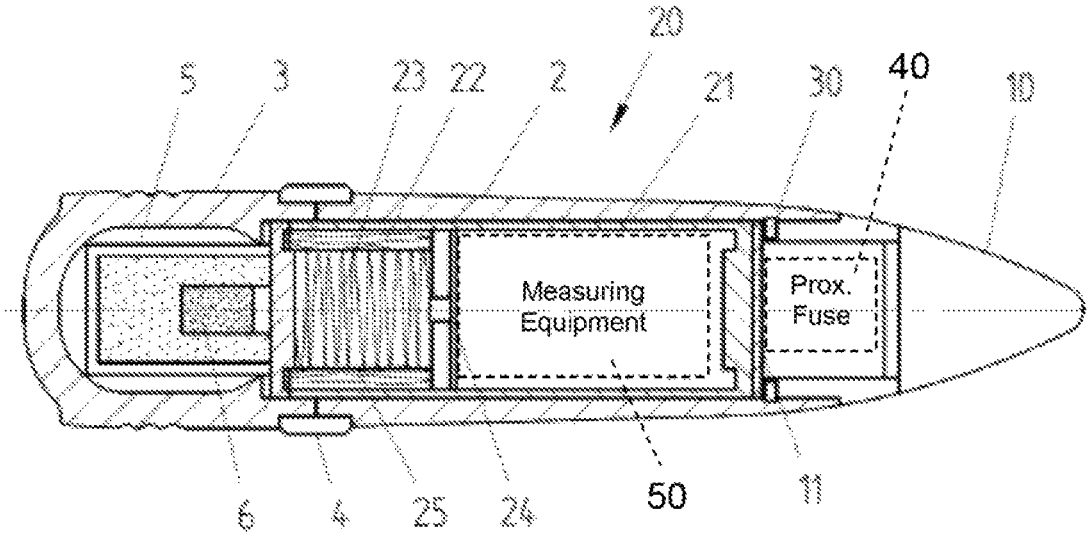
FIG. 2 schematically shows a longitudinal section of a separable projectile in a test embodiment, comprising a payload container comprising a measuring equipment, and a separation charge for separating the container with a payload from the projectile.

FIG. 2 shows the separable projectile 20 in a test embodiment for testing the projectile 20. In the test embodiment the payload container 21 comprises e measuring equipment 50 for registering acceleration stresses on the payload container during the launch phase and the velocity, altitude and temperature during the trajectory phase. In the test embodiment the projectile 20 differs in that it has no firing connection between the primer device 6 and the payload container 21, since there is no effect part 9 and no delay charges. Otherwise the projectile 20 in the test embodiment is identical to the projectile 1 in the effect embodiment.

The payload container 21 in the test embodiment is designed as a strong, integral unit, entirely or partially closed, intended to remain intact and not to disintegrate or break up after separation from the projectile. The payload container 21 with measuring equipment 50 may also be connected/coupled to a parachute 22 by parachute lines 23 connected to the payload container 21 via a ball bearing-guided pivot 24 on the rear end of the payload container 21. The parachute 22 is packed and arranged in a separable parachute container 25 of its own arranged behind or inside the payload container 21, preferably in a cylindrical space in the rear part of the payload container 21.

After separation of the payload container 21 and of the parachute container 25 from the projectile 20, the parachute container 25 is broken up into smaller parts at the same time that the parachute 22 is released and deploys, so that the payload container 21 with measuring equipment 50 slowly falls to the ground without the measuring equipment being damaged.

In an alternative embodiment, not shown, the effect part 9 of the projectile 1 in the effect embodiment of the projectile 1 is arranged in a payload container of the same type as that used for the measuring equipment in the test embodiment of the projectile 20, that is to a payload container that does not break up after separation from the projectile and which comprises a separable parachute container 25 with parachute 22. The payload container differs, however, in that its front end is open for releasing the effect part 9 when the payload container approaches a target.

The invention is not limited to the embodiments shown but may be modified in various ways without departing from the scope of the patent claims.

The invention claimed is:

1. A separable projectile comprising a front projectile body and a rear projectile body attached to the front projectile body and in which a separation charge is disposed, the separation charge being arranged behind a payload container, wherein the payload container comprises measuring equipment or an effect part, wherein the payload container is separable along its length in two or more parts after separation from the projectile for releasing the effect part.

2. The separable projectile according to claim 1, wherein the separation charge comprises a propellant charge comprising a smokeless nitrocellulose propellant.

3. The separable projectile according to claim 1, wherein the projectile comprises a pyrotechnic primer charge for initiating the separation charge.

4. The separable projectile according to claim 3, wherein the projectile comprises a proximity fuse for activating the pyrotechnic primer charge.

5. The separable projectile according to claim 1, wherein the payload container comprises measuring equipment for measuring at least one of acceleration stresses, velocity, altitude, and temperature of the projectile during an acceleration and a trajectory phase of the projectile.

6. The separable projectile according to claim 1, wherein the payload container consists of an integral unit, entirely or partially closed.

7. The separable projectile according to claim 1, wherein the payload container comprises the effect part comprising at least one effect projectile and at least one explosive charge for aimed effect against a target in the forward direction of the projectile.

8. The separable projectile according to claim 1, wherein the payload container comprises a delay charge for delayed initiation of the effect part of the payload container.

9. A method for modifying the separable projectile according to claim 1 from a test embodiment to an effect embodiment by:

detaching the front projectile body from the rear projectile body, removing the payload container comprising the measuring equipment from the front projectile body, after removing the payload container comprising the measuring equipment from the front projectile body, arranging another payload container in the front projectile body comprising the effect part, fitting the front projectile body to the rear projectile body by way of a belt.

10. A separable projectile comprising a front projectile body and a rear projectile body attached to the front projectile body and in which a separation charge is disposed, the separation charge being arranged behind a payload container, wherein the payload container comprises measuring equipment or an effect part, wherein the projectile comprises a parachute connected to the payload container for recovery of the payload container after separation from the projectile, and wherein a cavity in the payload container is partially disposed in the front projectile body and partially disposed in the rear projectile body and a portion of the cavity of the payload container for containing the measuring equipment or the effect part is entirely disposed in the front projectile body.

11. The separable projectile according to claim 10, wherein the parachute is arranged and packed in a separable parachute container arranged in or adjacent to a rear part of the payload container.

* * * * *